United States Patent [19]

Caruso

[11] 4,220,263

[45] Sep. 2, 1980

[54] COMBINED HOLDER FOR KEYS AND PROTECTIVE SPRAY

[76] Inventor: Albert P. Caruso, 147 Broadmoor Dr., Tonawanda, N.Y. 14150

[21] Appl. No.: 840,734

[22] Filed: Oct. 11, 1977

Related U.S. Application Data

[63] Continuation of Ser. No. 608,929, Aug. 29, 1975, abandoned.

[51] Int. Cl.[3] ..... B65D 83/14

[52] U.S. Cl. ..... 222/183

[58] Field of Search ..... 224/26 R, 2 B, 195, 224/228, 246, 191, 236; 222/180, 182, 183, 175; 273/84 R; 70/456 R

[56] References Cited

U.S. PATENT DOCUMENTS

| | | | |
|---|---|---|---|
| 2,699,192 | 1/1955 | Poutinen | 70/456 |
| 2,812,606 | 11/1957 | Painter | 40/130 |
| 2,940,641 | 6/1960 | Norrish et al. | 222/183 |
| 3,286,751 | 11/1966 | Dishart | 150/35 |
| 3,445,046 | 5/1969 | Wilson | 224/26 |
| 3,637,120 | 1/1972 | Clay | 224/246 |

OTHER PUBLICATIONS

Bucheimer Co., No. 171, Jan. 1971, p. 27, Mod. 60.

*Primary Examiner*—Stanley H. Tollberg
*Attorney, Agent, or Firm*—Joseph P. Gastel

[57] ABSTRACT

A combined holder for keys and protective spray consisting of a casing having a tubular body portion and a first end having an aperture therein for receiving a key ring and a second end having a flap with a fastener thereon, and an opening between the flap and the body portion to permit spray to emanate from the nozzle of a container held in the body portion when the container is actuated by pressing the flap.

9 Claims, 4 Drawing Figures

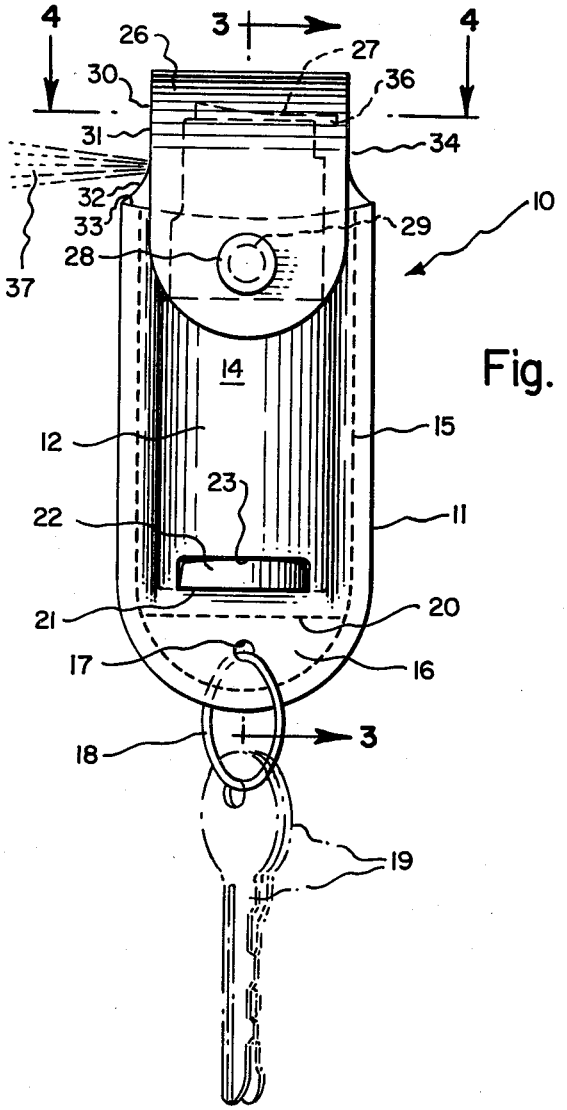
Fig. 1.
Fig. 2.
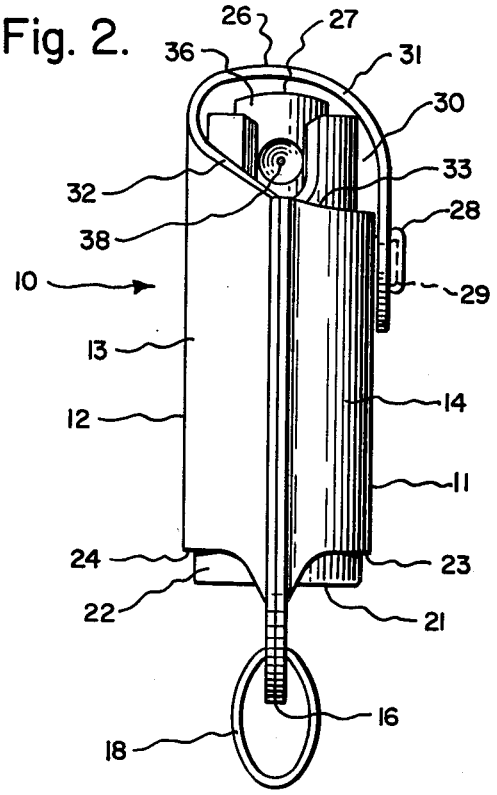
Fig. 3.
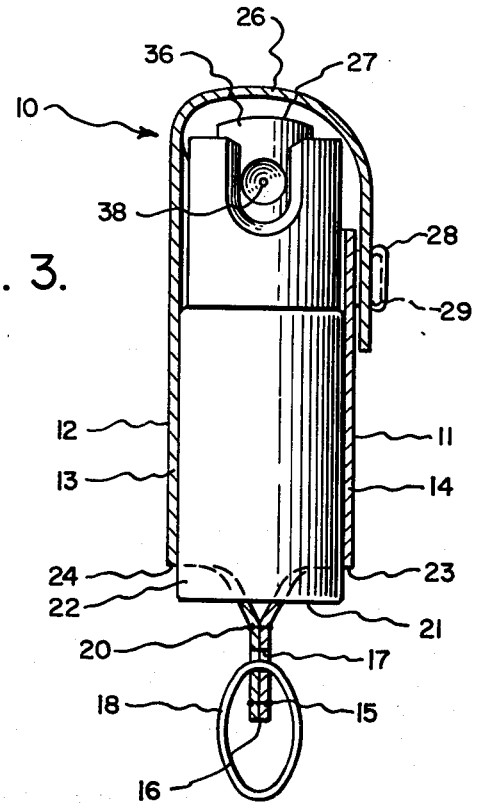
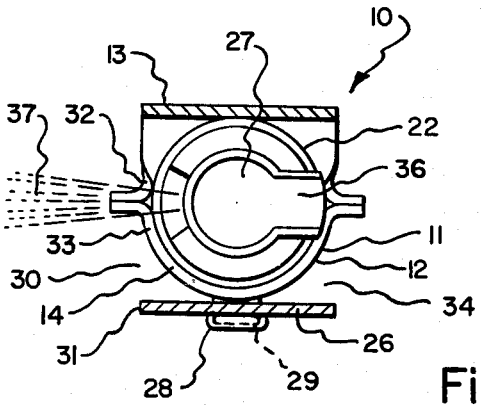
Fig. 4.

COMBINED HOLDER FOR KEYS AND PROTECTIVE SPRAY

This is a continuation, of application Ser. No. 608,929 filed on Aug. 29, 1975, now abandoned.

The present invention relates to a combined holder for keys and a protective spray.

In recent years the use of protective spray to ward off would-be attackers has become more prevalent. However, the protective spray container which was usually an aerosol can, was usually carried in the purse or the pocket and therefore was not readily accessible for use when needed.

It is accordingly one important object of the present invention to provide a combined holder for keys and protective spray which is always available in the hand of a person who is carrying the keys when approaching his car or his home.

Another object of the present invention is to provide a combined holder for keys and protective spray which is of a sufficiently small size that it can be carried in a very unobtrusive manner in the hand for instantaneous use.

A further object of the present invention is to provide an improved holder for keys and protective spray which holds the protective spray securely therein in a substantially concealed manner and which permits the spray to emanate from a suitable opening therein. Other objects and attendant advantages of the present invention will readily be perceived hereafter.

The combined holder for keys and protective spray of the present invention comprises a casing including a body portion for receiving a protective spray container, retaining means for retaining said container within said body portion, and key supporting means attached to said casing. In its more specific aspects, the combined holder carries the key supporting means at one end and has a flap at the other end, with an opening located between the flap and the body portion to permit the spray to emanate when the container is actuated by pressing through the flap.

The various aspects of the present invention will be more fully understood when the following portions of the specification are read in conjunction with the accompanying drawings wherein:

FIG. 1 is a side elevational view of the combined holder for keys and protective spray;

FIG. 2 is an end elevational view taken from the left of FIG. 1;

FIG. 3 is a cross sectional view taken substantially along line 3—3 of FIG. 1; and FIG. 4 is a cross sectional view taken substantially along line 4—4 of FIG. 1.

The combined holder 10 for keys and protective spray includes a casing 11 having a body portion 12 formed from a rear flexible panel 13 stitched to a front panel 14 along a U-shaped line of stitching 15 which runs along the entire border of panels 13 and 14. Casing 11 is preferably fabricated from leather, but may be fabricated from any other suitable material.

The lower portion 16 of casing 11 includes an aperture 17 which receives key ring 18 on which keys 19 are mounted. A horizontal row of stitching 20 runs across portion 16 between the substantially parallel sides of row of stitching 15. The row of stitching 20 in combination with the curved portion of row of stitching 15 rigidizes the casing in this area so as to provide a stop for the bottom 21 of cylindrical aerosol spray container 22 which is received within casing 11 with a tight fit so as to hold it securely in position against both moving out of the casing and against rotating while in the casing. A rectangular cutout 23 is formed in front panel 14 and an identical cutout 24 is formed in rear panel 13. These cutouts permit the portions of panels 13 and 14 above the cutouts to conform smoothly around the cylindrical surface of spray container 22.

A flap 26 is formed as an extension of rear panel 13 and it fits across the top 27 of the spray container and is fastened to panel 14 by means of a snap fastener 28 which cooperates with a button element 29 mounted on front panel 14. Flap 26 covers the top of spray container 22 and prevents it from working out of body portion 12, in the event that it for any reason should become loose therein. Flap 26 protects the structure mounted on the top of container 22 against snagging on or abutting foreign objects with the attendant possibility of accidental actuation of the spray.

An opening 30 is provided between the edge 31 of flap 26 and the edges 32 and 33 of panels 13, and 14, respectively. A like opening 34 is located at the opposite side of flap 26. It is to be noted that when casing 11 is held in the palm of the right hand with the snap fastener 28 facing away from the palm and the right thumb resting on flap 26, nozzle 28 will be pointing away from the person holding the casing. A left-handed person would carry the casing 11 with the snap fastener 28 against the palm of his left hand, so that nozzle 38 would point away from him. Alternatively, a left-handed person could rotate the container so that the spray would emanate from the diametrically opposite opening 34 when the snap fastener 28 was facing away from the palm of the left hand.

When it is desired to actuate the spray, button 36 is depressed by pressing down on it with the right thumb through flap 26, and the aerosol within container 22 will cause a spray 37 to emanate from nozzle 38. This spray is preferably a suitable commercially available skin and eye irritant, such as orthochlorobenzalmalonitrile, which will incapacitate an attacker without causing permanent injury.

It can readily be seen that the combined holder of the present invention is extremely convenient to use inasmuch as it is usually carried in the hand of a person who is either approaching his house or his car because he must use the keys carried thereon to enter.

When not being carried in the hand, the combined holder 10 can be conveniently carried in a pocket of a man or a purse of a woman because of its small size. In this respect the holder 10, exclusive of the key ring, is approximately four inches long, one and one-half inches wide and about one inch in diameter from front to back. When carried in the hand, it is substantially concealed therein because of its small size.

It can thus be seen that the combined holder for keys and protective spray is manifestly capable of achieving the above enumerated objects, and while a preferred embodiment has been disclosed, it will readily be appreciated that the present invention is not limited thereto but may be otherwise embodied within the scope of the following claims.

What is claimed is:

1. A combined holder for keys and a protective spray container for carrying in a pocket or purse comprising a casing including a body portion for receiving a protective spray container containing an actuating button and a nozzle for dispensing a spray for warding off an attacker, retaining means for retaining said container within said body portion, and key-supporting means attached to said casing, said body portion being tubular and including first and second opposite ends, said retaining means comprising a flap located at said first end, said container being oriented in said body portion with said actuating button and said nozzle proximate said first end, said key-supporting means being located at said second end, said casing including a front panel and a rear panel stitched to said front panel, said flap comprising an extension of said rear panel, first fastener means on said flap, second fastener means on said front panel for coacting with said first fastener means to maintain said flap in a closed position, said flap being movable to permit said actuating button of said container to be digitally actuated by pressing on said flap, and an open space between said flap and said body portion to permit a spray to emanate from said nozzle and project beyond said casing while said flap is closed.

2. A combined holder for keys and a protective spray container for carrying in a pocket or purse comprising a casing including a body portion having first and second opposite ends for receiving a protective spray container containing an actuating button and a nozzle for dispensing a spray for warding off an attacker, retaining means for retaining said container within said body portion, key-supporting means attached to said casing, said body portion being tubular to receive said container, said retaining means comprising a flap attached to said body portion at said first end for effectively closing the end of said body portion, said container being oriented in said body portion with said actuating button and said nozzle proximate said first end, said flap being movable to permit said actuating button of said container to be digitally actuated by pressing on said flap, and an open space between said flap and said body portion at said first end to permit a spray to emanate from said nozzle and project beyond said casing while said flap is closed.

3. A combined holder for keys and a protective spray container as set forth in claim 2 wherein said key-supporting means is located at said second end of said body portion.

4. A combined holder for keys and a protective spray container as set forth in claim 2 wherein said retaining means includes a tight fit between said body portion and said container.

5. A combined holder for keys and a protective spray container as set forth in claim 1 including a row of stitching securing said first and second panels at said second end to provide a stop for said container, and cutouts located proximate said row of stitching and between said row of stitching and said flap.

6. A combined holder for keys and a protective spray container as set forth in claim 3 wherein said key-supporting means comprises a key ring.

7. A combined holder for keys and a protective spray container for carrying in a pocket or purse comprising a casing including a body portion for receiving a protective spray container containing an actuating button and a nozzle for dispensing a spray for warding off an attacker, retaining means for retaining said container within said body portion, and key-supporting means attached to said casing, said body portion being tubular and including first and second opposite ends, said retaining means comprising a flap located at said first end, said container being oriented in said body portion with said actuating button and said nozzle proximate said first end, said key-supporting means being located at said second end, said flap being movable to permit said actuating button of said container to be digitally actuated by pressing on said flap, an open space at said first end between said flap and said body portion to permit a spray to emanate from said nozzle and project beyond said casing while said flap is closed, and cutout means in said body portion proximate said second end to permit said casing to conform to said container.

8. A combined holder for keys and a protective spray container as set forth in claim 7 including means for joining opposite sides of said casing to each other at said second end on the opposite side of said cutouts from said flap, to thereby provide a stop for said container at said second end.

9. A combined holder for keys and a protective spray container as set forth in claim 8 wherein said key-supporting means comprises a ring, and an aperture in said second end for mounting said ring.

* * * * *

US004220263B1

REEXAMINATION CERTIFICATE (3278th)

United States Patent [19] [11] B1 4,220,263

Caruso [45] Certificate Issued Jul. 22, 1997

[54] COMBINED HOLDER FOR KEYS AND PROTECTIVE SPRAY

[75] Inventor: Albert P. Caruso, Tonawanda, N.Y.

[73] Assignee: W. Simon Katz, Buffalo, N.Y.

Reexamination Request:
No. 90/004,460, Nov. 19, 1996

Reexamination Certificate for:

| | |
|---|---|
| Patent No.: | **4,220,263** |
| Issued: | **Sep. 2, 1980** |
| Appl. No.: | **840,734** |
| Filed: | **Oct. 11, 1977** |

Related U.S. Application Data

[63] Continuation of Ser. No. 608,929, Aug. 29, 1975, abandoned.

[51] Int. Cl.[6] ..... B67D 5/06

[52] U.S. Cl. ..... 222/183

[56] References Cited

PUBLICATIONS

Newpaper advertisement for the "Chemical Lance" appearing in the Nov. 10, 1974 edition of the Orlando, FL, *Sentinel Star.*

Product catalogue of Bucheimer–Clark Co., 25562 Avenue, Valencia California, dated Jan. 1993 showing Police Accessories including "Mace Carriers".

Magazine advertisement for the "Curb 60 Jet Stream" aerosol teargas hand unit appearing in the Jan. 1974 issue of *The Police Chief.*

*Primary Examiner*—Gregory L. Huson

[57] ABSTRACT

A combined holder for keys and protective spray consisting of a casing having a tubular body portion and a first end having an aperture therein for receiving a key ring and a second end having a flap with a fastener thereon, and an opening between the flap and the body portion to permit spray to emanate from the nozzle of a container held in the body portion when the container is actuated by pressing the flap.

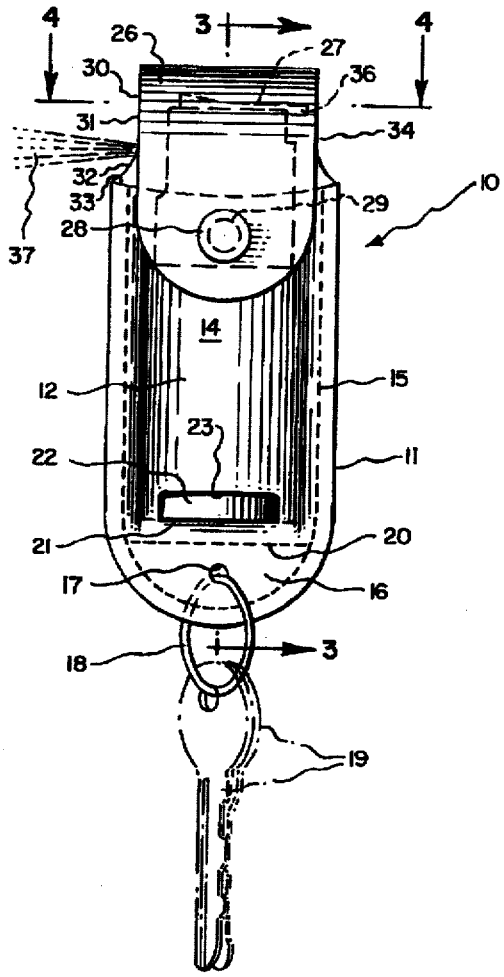

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 are confirmed.

* * * * *